United States Patent [19]

DiPersio et al.

[11] Patent Number: 4,813,274

[45] Date of Patent: Mar. 21, 1989

[54] METHOD FOR MEASUREMENT OF AZIMUTH OF A BOREHOLE WHILE DRILLING

[75] Inventors: Richard D. DiPersio, Meriden; Martin E. Cobern, Cheshire, both of Conn.

[73] Assignee: Teleco Oilfield Services Inc., Meriden, Conn.

[21] Appl. No.: 54,616

[22] Filed: May 27, 1987

[51] Int. Cl.[4] ..... E21B 47/00

[52] U.S. Cl. ..... 73/151; 33/313

[58] Field of Search ..... 73/151, 152; 33/302, 33/304, 312, 313; 364/422; 299/1; 175/45, 50

[56] References Cited

U.S. PATENT DOCUMENTS 3,753,296 8/1973 van Steenwyk ..... 33/304
4,399,692 8/1983 Hulsing, II et al. ..... 33/313 X
4,682,421 7/1987 van Dongen et al. ..... 33/302
4,709,486 12/1987 Walters ..... 33/312 X

FOREIGN PATENT DOCUMENTS 2122751 1/1984 United Kingdom .

OTHER PUBLICATIONS

Deo et al. "An Analysis of the Angles of Rotation and Azimuth using M.W.D", Gearhart Geodata Service Ltd. prior to Jun., 1988.

*Primary Examiner*—Eugene R. LaRoche
*Assistant Examiner*—Seung Ham
*Attorney, Agent, or Firm*—Fishman, Dionne & Cantor

[57] ABSTRACT

A method is presented for measuring the azimuth angle of a borehole being drilled, the data for determining the azimuth angle being obtained while the drillstring is rotating.

10 Claims, 2 Drawing Sheets

METHOD FOR MEASUREMENT OF AZIMUTH OF A BOREHOLE WHILE DRILLING

BACKGROUND OF THE INVENTION

This invention relates to the field of borehole measurement. More particularly, this invention relates to the field of measurement while drilling (MWD) and to a method of measuring the parameter of azimuth while the drill string is rotating.

Another patent application (Ser. No. 054,552) for an invention by Martin E. Cobern and Richard D. DiPersio for a different system for measuring azimuth while rotating is being filed contemporaneously herewith. Both applications are assigned to the assignee hereof.

In MWD systems, the conventional approach is to take certain borehole parameter readings or surveys only when the drillstring is not rotating. U.S. Pat. No. 4,013,945, owned by the assignee hereof, discloses and claims apparatus for detecting the absence of rotation and initiating the operation of parameter sensors for determining azimuth and inclination when the absence of rotation is sensed. While there have been several reasons for taking various MWD measurements only in the absence of drill string rotation, a principal reason for doing so for the drillers angles of azimuth and inclination is that previous methods for the measurement or determination of these angles required the tool to be stationary in order for the null points of single axis devices to be achieved or to obtain the averaging necessary when triaxial magnetometers and triaxial accelerometers are used for determining azimuth and inclination. That is, when triaxial magnetometers and accelerometers are used, the individual field measurements necessary for determination of azimuth and inclination are dependent on instantaneous tool face angle when the measurements are taken. This is so because during rotation the x and y axis magnetometer and accelerometer readings are continually varying, and only the z axis reading is constant. (In referring to x, y and z axis, the frame of reference is the borehole (and the measuring tool), with the z axis being along the axis of the borehole (and tool), and with the x and y axes being mutually perpendicular to the z axis and each other. That frame of reference is to be distinguished from the earth frame of reference of east (E), north (N) (or horizontal) and vertical (D) (or down).

There are, however, circumstances where it is particularly desirable to be able to measure azimuth and inclination while the drillstring is rotating. This requirement has led to the present invention of a method for measurement of azimuth and inclination while drilling. Examples of such circumstances include (a) wells where drilling is particularly difficult and any interruption in rotation will increase drill string sticking problems, and (b) situations where knowledge of instantaneous bit walk information is desired in order to know and predict the real time path of the borehole. A system has heretofore been proposed and used for obtaining inclination while the drillstring is rotating. The present invention also makes it possible to obtain azimuth while rotating.

BRIEF DESCRIPTION OF THE DRAWINGS

Referring now to the drawings, wherein like elements are numbered alike in the several Figures.

DESCRIPTION OF THE PREFERRED EMBODIMENT

The method of the present invention is intended to be implemented in conjunction with the normal commercial operation of a known MWD system and apparatus of Teleco Oilfield Services Inc. (the assignee hereof) which has been in commercial operation for several years. The known system is offered by Teleco as its CDS (Computerized Directional System) for MWD measurement; and the system includes, inter alia, a triaxial magnetometer, a triaxial accelerometer, control, sensing and processing electronics, and mud pulse telemetry apparatus, all of which are located downhole in a rotatable drill collar segment of the drill string. The known apparatus is capable of sensing the components Gx, Gy and Gz of the total gravity field Go; the components Hx, Hy and Hz of the total magnetic field Ho; and determining the tool face angle and dip angle (the angle between the horizontal and the direction of the magnetic field). The downhole processing apparatus of the known system determines azimuth angle (A) and inclination angle (I) in a known manner from the various parameters. See e.g., the article "Hand-Held Calculator Assists in Directional Drilling Control" by J. L. Marsh, *Petroleum Engineer International,* July & September, 1982.

Figure 1:
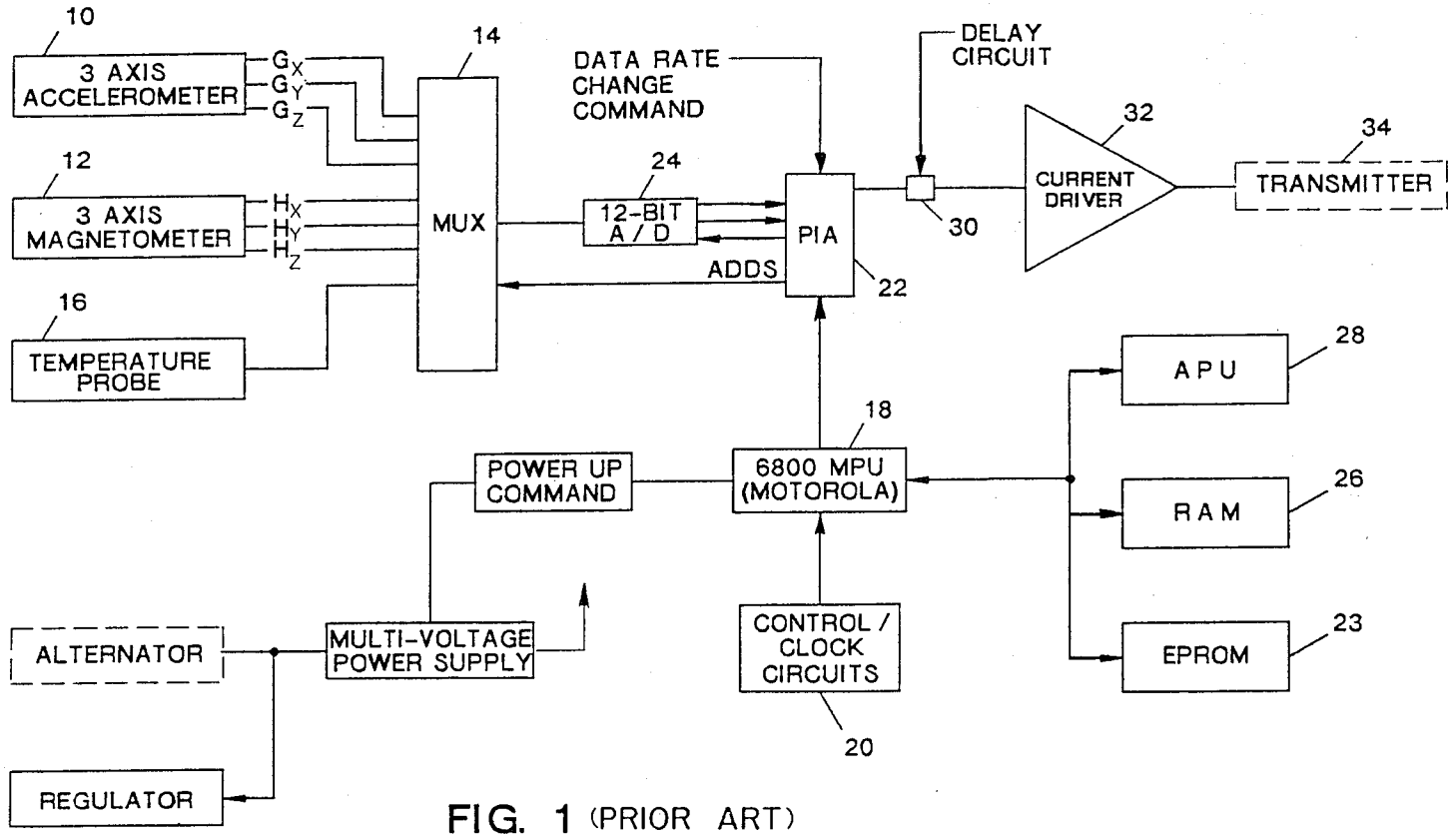
FIG. 1 (PRIOR ART)
FIG. 1 is a block diagram of a computerized directional system in accordance with the prior art.

Referring to FIG. 1, a block diagram of the known CDS system of Teleco is shown. This CDS system is located downhole in the drill string in a drill collar near the drill bit. This CDS system includes a 3-axis accelerometer 10 and a 3-axis magnetometer 12. The x axis of each of the accelerometer and the magnetometer is on the axis of the drillstring. To briefly and generally describe the operation of this system, accelerometer 10 senses the Gx, Gy and Gz components of the downhole gravity field Go and delivers analog signals commensurate therewith to a multiplexer 14. Similarly, magnetometer 12 senses the Hx, Hy and Hz components of the downhole magnetic field. A temperature sensor 16 senses the downhole temperature of the accelerometer and magnetometer and delivers a temperature compensating signal to multiplexer 14. The system also has a programmed microprocessor unit 18, system clocks 20 and a peripheral interface adapter 22. All control, calculation programs and sensor calibration data are stored in EPROM Memory 23.

Under the control of microprocessor 18, the analog signals to multiplexer 14 are multiplexed to the analog-to-digital converter 24. The output digital data words from A/D converter 24 are then routed via peripheral interface adapter 22 to microprocessor 18 where they are stored in a random access memory (RAM) 26 for the calculation operations. An arithmetic processing unit (APU) 28 provides off line high performance arithmetic and a variety o trigonometry operations to enhance the power and speed of data processing. The digital data for each of Gx, Gy, Gz, Hx, Hy, Hz are averaged in arithmetic processor unit 24 and the data are used to calculate azimuth and inclination angles in microprocessor 18. These angle data are then delivered via delay circuitry 30 to operate a current driver 32 which, in turn, operates a mud pulse transmitter 34, such as is described, for example, in U.S. Pat. No. 4,013,945.

In the prior art normal operation of the CDS system, the accelerometer and magnetometer readings are taken during periods of nonrotation of the drill string. As many as 2000 samples of each of Gx, Gy, Gz, Hx, Hy and Hz are taken for a single reading, and these samples are averaged in APU 26 to provide average readings for each component. A procedure has also previously been implemented to determine inclination (I) while the drill string was rotating. In that procedure, the Gz component of the gravity field is determined from an average of samples obtained while rotating, and the inclination angle (I) is determined from the simple relationship $$\tan(I) = \frac{\sqrt{Go^2 - Gz^2}}{Gz} \tag{1}$$

where Go is taken to be 1G (i.e., the nominal value of gravity). This system is acceptable for measuring inclination while rotating, because the z axis component Gz is not altered by rotation.

Figure 2B:
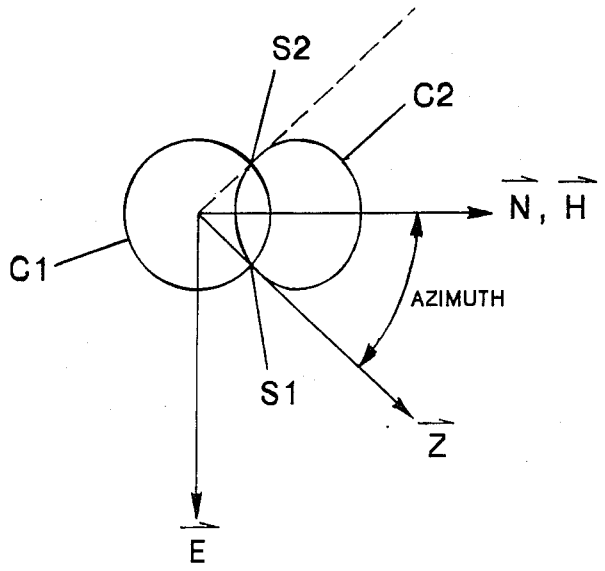
FIG. 2B is a diagrammatic view showing the cones of FIG. 2A projected onto a horizontal plane.
Figure 2A:
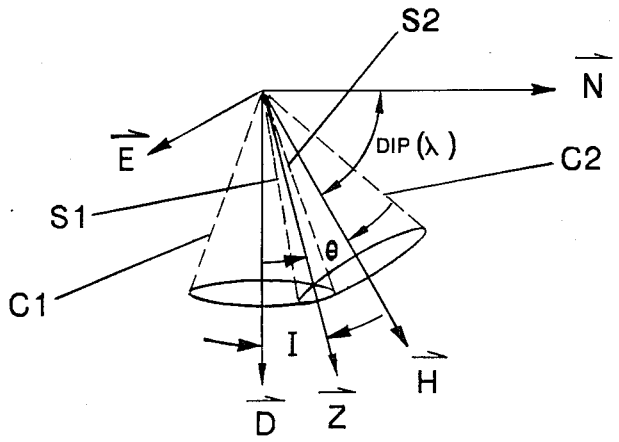
FIG. 2A is a diagrammatic view of the angles and axis of interest in a borehole.

In accordance with the present invention, the parameter of azimuth angle (A) is now also obtained while rotating. Before discussing the specifics of the azimuth measuring technique, reference is made to FIGS. 2A and 2B for a preliminary discussion of some of the angles involved and the process employed in this invention. Referring first to FIG. 2A, the orthogonal directions east (E), north (N) and down (D) (or vertical) are shown. The axis of the borehole and of the tool in the borehole is indicated as Z. The inclination angle I is the included angle between the Z axis and the D axis. However, without knowing azimuth, the direction of I is undetermined; all one knows about the measured inclination angle is that it is an angle of a certain magnitude, and its direction may lie anywhere on the surface of an imaginary right circular cone of half angle (I) about the D direction. That imaginary cone is indicated at $C_1$. Dip angle (i.e., the angle the direction of the magnetic field Ho makes with the horizontal) can be determined from measured parameters (see Eq. 6 below). An angle $\theta$, which is the angle between the direction of Ho and the Z axis, is defined by this invention. The angle $\theta$ has not heretofore been used in determining azimuth. A second imaginary cone $C_2$ is defined which is a right circular cone of half angle $\theta$ about the direction of Ho. Cone $C_2$ intersects cone $C_1$, at two lines $S_1$ and $S_2$, which represent two solutions to the final equation (Eqs. 7 or 8) used in the process of this invention. FIG. 2B shows the cones $C_1$ and $C_2$ of FIG. 2A projected into the horizontal plane. As seen in FIG. 2B, cone $C_1$ projects into a circle around the D axis (into the plane of the paper at the center of $C_1$), and cone $C_2$ projects into an elipse around the north (N) axis which intersects $C_1$ at the two locations $S_1$ and $S_2$. From FIG. 2A it can be seen that the following relationships exist:

$$Gz = Go\ \mathrm{Cos}(I);\ \text{or}\ \mathrm{Cos}(I) = Gz/Go \tag{2}$$

$$Hz = Ho\ \mathrm{Cos}(\theta);\ \text{or}\ \mathrm{Cos}(\theta) = Hz/Ho \tag{3}$$

In the method of the present invention, measurements of Gx, Gy and Gz and Hx, Hy and Hz are taken during each period of nonrotation, and the most recent set of those measurements is stored in RAM 26. When it is desired to obtain an azimuth reading while rotating, microprocessor 18 proceeds to determine Go and Ho from the relationships $$Go = \sqrt{Gx^2 + Gy^2 + Gz^2} \tag{4}$$

and $$Ho = \sqrt{Hx^2 + Hy^2 + Hz^2} \tag{5}$$

where Gx, Gy, Gz, Hx, Hy and Hz are the most recent nonrotative values in RAM 26. Then, real time readings while rotating are taken of Gz and Hz. As in the nonrotating case, a large number (typically 2000–4000) of instantaneous readings are taken over about 10 seconds, and they are averaged to get real time values of Gz and Hz. For Gz the averaging reduces or eliminates the effects of axial vibration on each instantaneous measurement of Gz. These real time values are then delivered to microprocessor 18 where the inclination (I) is determined from equation (2)

$$\mathrm{Cos}(I) = Gzr/Go$$

where Gzr is the value of Gz measured while rotating and Go is determined by equation (4) from the most recent stored nonrotating values of Gx, Gy and Gz. Alternatively, (I) can be determined from equation (1)

$$\tan(I) = \frac{\sqrt{Go^2 - Gzr^2}}{Gzr}$$

Also, the angle $\theta$ is determined in microprocessor 18 from equation (3)

$$\cos(\theta) = Hzr/Ho$$

where Hzr is the value of Hz measured while rotating and Ho is determined by equation (5) from the most recent stored nonrotating values of Hx, Hy and Hz.

The angle $\theta$ can also be determined from $$\tan(\theta) = \frac{\sqrt{Ho^2 - Hzr^2}}{Hzr} \tag{3(A)}$$

The dip angle ($\lambda$) is also calculated by microprocessor 18 from the relationship $$\lambda = \arcsin \frac{Gx\,Hx + Gy\,Hy + Gz\,Hz}{Go\,Ho} \tag{6}$$

where Gx, Gy, Gz, Hx, Hy and Hz are the most recent stored nonrotative values and Go and Ho are determined from equations (4) and (5), respectively.

Next in the process, the azimuth angle (A) is calculated by microprocessor 18 from the relationship $$(A) = \arccos \frac{\mathrm{Cos}(\theta) - \mathrm{Cos}(I)\sin(\lambda)}{\sin(I)\cos(\lambda)} \tag{7}$$

The real time values of both inclination angle (I) and azimuth angle (A) are transmitted to the surface by transmitter 30 for use and processing at the surface by the driller and others.

Since $\cos(\theta) = Bz/Bo$ and $\mathrm{Cos}(I) = Gz$, equation (7) can also be written as $$A = \text{arc Cos}\,\frac{GoBz - BoGz\sin\lambda}{Bo\cos(Go^2 - Gz^2)^{\frac{1}{2}}} \qquad 7(A)$$

Rather than calculating the dip angle from equation (6), the value of λ can be determined from relevant charts and stored in the memory. Also, while the method of this invention has been described in terms of downhole calculations from the measured data, it will, of course, also be understood that the measured data Gx, Gy, Gz, Hx, Hy, Hz can be transmitted to the surface and the calculations done there. It will also be understood that all steps and calculations may be carried out under the program control of microprocessor 18 by means of any suitable program within the ordinary skill in the art or by modifications to the already existing program for operation of the CDS system, such modifications being within the ordinary skill in the art.

As an alternative to determining azimuth angle (A) from equation (7), it may be determined from the relationship $$\tan^2(A) = \frac{\cos^2(\lambda)\sin^2(\theta) - [\cos(\theta)\sin(\lambda) - \cos(I)]^2}{\cos^2(\lambda)[\sin^2(I) - \sin^2(\theta)] + [\cos(\theta)\sin(\lambda) - \cos(I)]^2} \qquad (8)$$

In both equations (7) and (8) the value for (I) may be either the value determined from the most recent nonrotating survey or the real time value measured while rotating. In cases of difficult drilling conditions (e.g., high axial vibrations) where the z axis accelerometer may be saturated, the value of (I) determined from the most recent nonrotating survey would preferably be used; otherwise it is preferable to use the real time value determined while rotating.

It is to be noted that there are two solutions to each of equations (7) and (8). There is enough information to determine the magnitude of the azimuth angle, but not its sign. In most cases, this will not be a problem, since the angle will change only slightly from the most recent value determined while nonrotating. Ambiguity in sign will occur only when the drilling is close to the north or south.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method for determining the azimuth angle of a borehole being drilled by instruments contained downhole in the drillstring, including the steps of:

sensing with accelerometer means, during a period of nonrotation of the drillstring, the components of Gx, Gy and Gz of the total gravity field Go at the location of the instrument;

sensing with magnetometer means, during a period of nonrotation of the drillstring, the components of Hx, Hy and Hz of the total magnetic field Ho at the location of the instrument;

the components Gz and Hz being along the axis of the drillstring, the components Gx and the components and Gy being orthogonal to Gz and the components Hx and Hy being orthogonal to Hz;

rotating said magnetometer means with said drillstring and obtaining the parameter Hzr which is the Hz component of the magnetic field at the location of the instrument during rotation of the drillstring;

determining Ho from values Hx, Hy and Hz sensed during nonrotation of the drillstring;

determining the inclination angle of the drillstring;

determining the dip angle λ of the magnetic field;

determining the angle θ between the direction of the magnetic field and the axis of the drillstring at the location of the instrument from Ho and Hzr; and determining the azimuth angle (A) either from the relationship:

$$(A) = \text{arc Cos}\,\frac{\text{Cos}(\theta) - \text{Cos}(I)\sin(\lambda)}{\sin(I)\cos(\lambda)}$$

or from the relationship $$\tan^2(A) = \frac{\cos^2(\lambda)\sin^2(\theta) - [\cos(\theta)\sin(\lambda) - \cos(I)]^2}{\cos^2(\lambda)[\sin^2(I) - \sin^2(\theta)] + [\cos(\theta)\sin(\lambda) - \cos(I)]^2}$$

2. The method of claim 1 wherein:

the angle θ is determined from either the relationship $$\cos(\theta) = Hzr/Ho$$

or from the relationship $$\tan(\theta) = \frac{\sqrt{Ho^2 - Hzr^2}}{Hzr}$$

3. The method of claim 2 wherein:

Ho is determined from the values of Hx, Hy and Hz sensed during nonrotation.

4. The method of claim 3 including:

determining Go from the values of Gx, Gy and Gz sensed during nonrotation, and determining the inclination angle from the relationship $$I = \text{arc Cos}\,(Gzr/Go)$$

where Gzr is the Gz component of the gravity field at the location of the instrument during rotation of the drillstring.

5. The method of claim 1 including:

determining Go from the values of Gx, Gy and Gz sensed during nonrotation, and determining the inclination angle from the relationship $$I = \text{arc Cos}\,(Gzr/Go)$$

where Gzr is the Gz component of the gravity field at the location of the instrument during rotation of the drillstring.

6. A method for determining the azimuth angle of a borehole being drilled by instruments contained downhole in the drillstring, including the steps of:

determining with accelerometer means, during a period of nonrotation of the drillstring, the total gravity field Go at the location of the instrument;

determining with magnetometer means, during a period of nonrotation of the drillstring, the total magnetic field Ho at the location of the instrument;

rotating said magnetometer means with said drillstring and obtaining the parameter Hzr which is the component of the magnetic field along the axis of the drillstring at the location of the instrument during rotation of the drillstring;

determining the inclination angle of the drillstring;

determining the dip angle λ of the magnetic field;

determining the angle θ between the direction of the magnetic field and the axis of the drillstring at the location of the instrument; and determining the azimuth angle (A) either from the relationship:

$$(A) = \text{arc Cos}\,\frac{\text{Cos}(\theta) - \text{Cos}(I)\sin(\lambda)}{\sin(I)\cos(\lambda)}$$

or from the relationship $$\tan^2(A) = \frac{\cos^2(\lambda)\sin^2(\theta) - [\cos(\theta)\sin(\lambda) - \cos(I)]^2}{\cos^2(\lambda)[\sin^2(I) - \sin^2(\theta)] + [\cos(\theta)\sin(\lambda) - \cos(I)]^2}$$

7. The method of claim 6 wherein:

the angle θ is determined from either the relationship $$\cos(\theta) = Hzr/Ho$$

or from the relationship $$\tan(\theta) = \frac{\sqrt{Ho^2 - Hzr^2}}{Hzr}$$

8. The method of claim 7 wherein:

Ho is determined from the values of Hx, Hy and Hz sensed during nonrotation.

9. The method of claim 8 including:

determining Go from the values of Gx, Gy and Gz sensed during nonrotation, and determining the inclination angle from the relationship $$I = \text{arc Cos}\,(Gzr/Go)$$

where Gzr is the Gz component of the gravity field at the location of the instrument during rotation of the drillstring.

10. The method of claim 6 including:

determining Go from the values of Gx, Gy and Gz sensed during nonrotation, and determining the inclination angle from the relationship $$I = \text{arc Cos}\,(Gzr/Go)$$

where Gzr is the Gz component of the gravity field at the location of the instrument during rotation of the drillstring.

* * * * *